United States Patent [19]

Hayslip

[11] 3,972,386

[45] Aug. 3, 1976

[54] RESCUE APPARATUS

[75] Inventor: Raymond W. E. Hayslip, Milton, Fla.

[73] Assignee: Lawrence Peska Associates, Inc., New York, N.Y. ; a part interest

[22] Filed: Dec. 23, 1975

[21] Appl. No.: 643,782

[52] U.S. Cl. ..... 182/50

[51] Int. Cl.[2] ..... A62B 1/18

[58] Field of Search ..... 182/50

[56] References Cited

UNITED STATES PATENTS

| | | | |
|---|---|---|---|
| 276,090 | 4/1883 | Sperry | 182/50 |
| 328,331 | 10/1885 | Montague | 182/50 |
| 495,505 | 4/1893 | Martin | 182/50 |
| 2,490,378 | 12/1949 | Mount | 182/50 |

*Primary Examiner*—Reinaldo P. Machado

[57] ABSTRACT

Rescue apparatus is disclosed comprising a projectile launched from a launching tube, one end of the projectile having grappling hook members projecting therefrom, the opposite end of the projectile having fins for stabilizing the projectile in flight and a pully mounted intermediate the ends for receiving a rope which is payed out from two storage containers separated a sufficient distance so that the rope does not entangle with the fins of the projectile when the projectile is in flight. Once the grappling hook is set in an area where a rescue is to be attempted such as the roof of a building, the rope may be employed to raise a ladder to that point where the grappling hook is secured. A winch is also provided for assisting in either raising the rope or other apparatus needed in the rescue operation.

9 Claims, 5 Drawing Figures

RESCUE APPARATUS

The present invention relates to rescue apparatus and comprises a projectile, one end of the projectile having grappling hook members projecting therefrom the opposite end of the projectile having fins thereon for stabilizing the projectile in flight. A pulley is mounted on the projectile intermediate the ends thereof, a first rope storage member and a second rope storage member being provided for paying out rope to the projectile while the projectile is in flight. A rope is secured in and leads from said storage member over the pulley into and secured to the second storage container, the length of the rope being at least twice the distance to be traversed by the projectile. The first and second rope storage containers are separated for a distance sufficient to keep the rope away from the fin of the projectile when the projectile is in flight.

The pulley is rotatably mounted on an axle secured to the projectile the axle being transverse to and passes through the longitudinal axis of the projectile, the axle being rotatable about in a plane passing through longitudinal axis on pivot members for allowing the axle to move through an arc of up to about 45°.

A ladder is provided which is securable to one end of the rope, a winch also being provided which is also connectable to the rope.

In a further embodiment, the pulley is mounted on an axle passing through the center of gravity of the projectile, the pulley diameter also being greater than the span of the fins to further prevent the rope from becoming entangled in the fins when the projectile is in flight.

The projectile may be launched from a launching member such as a launching tube or cannon by a propellant charge placed in the launcher or a propellant charge mounted on the projectile such as in the case of using a rocket propellant to launch the projectile.

DETAILED DESCRIPTION

Figure 1:
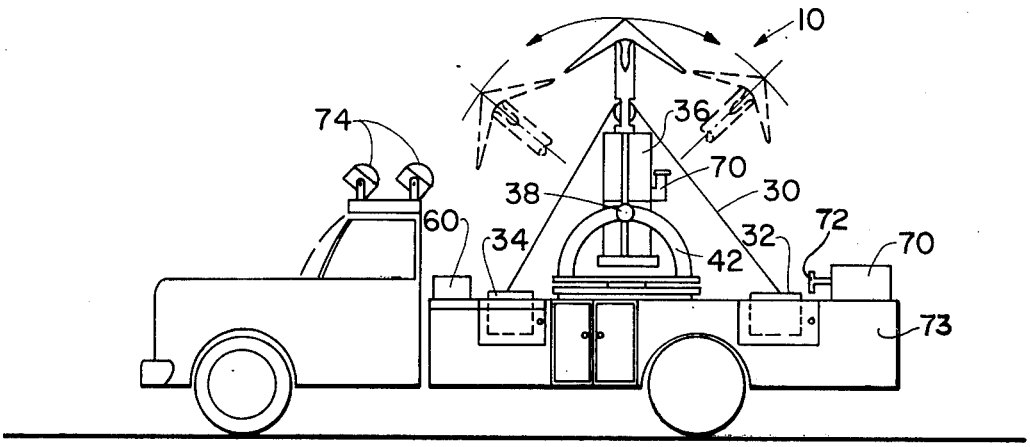
FIG. 1 is a side elevation illustrating the projectile mounted in a launcher which is affixed to a vehicle according to one embodiment of the present invention.

Rescue devices are known in the prior art which comprise projectiles that are fired from launching tubes and which have a rope secured thereto which is payed out while the projectile is in flight. Some of the projectiles of the prior art carry a pulley so that a strand of rope may be run therethrough, both ends of the rope being secured at some point on ground level so that when the projectile is fixed onto an object to which the rope is to be strung, rescue apparatus such as a cage or a ladder may be pulled up to the projectile by means of the rope. The positioning of the pulley in the projectile has presented some difficulty in the prior art since if placed in the tail, the explosive force of a launching charge has a tendency either to jam the pulley or scorch the rope of both. The problem of positioning the pulley to avoid these difficulties has been obviated to some degree in the prior art by putting the pulley on an arm which extends forward from a pivot secured to the tail of the projectile whereby the pulley is positionable outside the muzzle of a launching gun thereby avoiding damage to the pulley or the rope by the discharge of the explosive propellant. When in flight, the pivot allows the pulley on the end of the arm to fold backwards and trail behind the projectile. The problem is not entirely obviated by the apparatus since the pivot which is secured to the tail of the projectile also receives an explosive charge and would have a tendency to jam before the arm can be swung backwards to allow the rope to trail behind the projectile. The latter device is disclosed in U.S. Pat. No. 276,090 Sperry.

U.S. Pat. No. 569,810 Carey discloses a projectile having a pulley mounted in the tail; however, the positioning of the pulley in this manner again exposes it to an explosive charge when the projectile is launched from a mortar or cannon as employed in the Carey reference.

Other apparatus employed in the prior art for securing a line to an object by means of a projectile include U.S. Pat. Nos. 1,069,088 Taylor; 598,110 Petersen; 530,525 Hoekstra; 495,505 Martin; 424,460 Burt; and 291,441 Watts.

It is therefore an object of the present invention to overcome these and other difficulties encountered in the prior art.

It is a further object of the present invention to provide rescue apparatus comprising a projectile for securing a line or a rope to a distant object such as the upper floors of a building or similar structure.

It is also an object of the present invention to provide a projectile having grappling hooks thereon and a pulley for receiving a line, both ends of the line being secured to the launching area of the projectile so that the line and the pulley, once the grappling hook on the end of the projectile is set into an object, may be employed to bring objects up to the point where the projectile is secured by means of the grappling hooks.

It is a further object of the present invention to provide a pulley in a projectile which is not exposed to the launching charge used to propel the projectile.

These and other objects have been achieved according to the present invention and will become apparent from the disclosure and claims that follow as well as the appended drawing.

Figure 2:
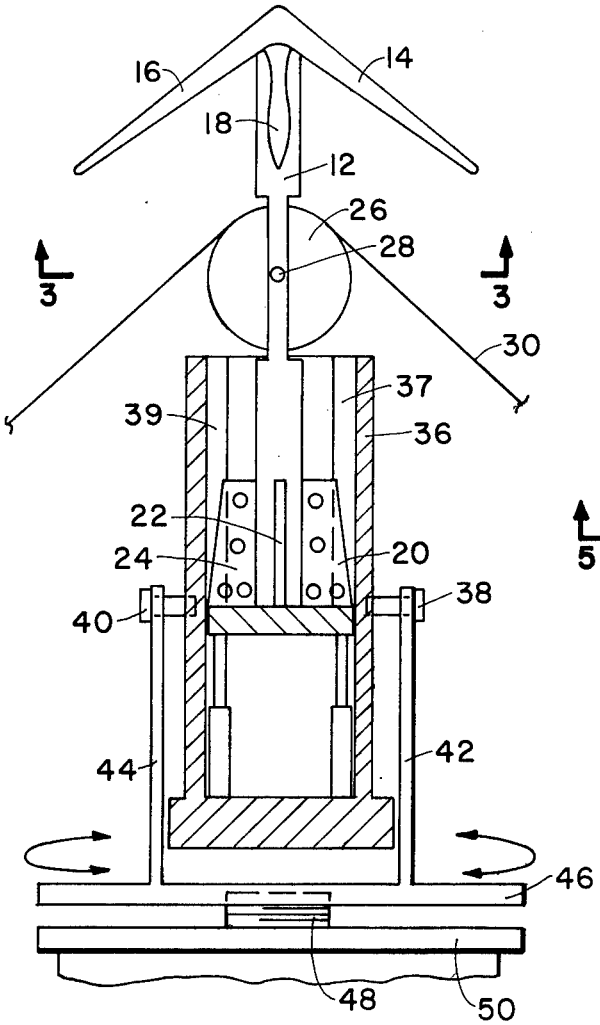
FIG. 2 is a side elevation in section illustrating in greater detail the projectile and launching tube of the rescue apparatus according to one embodiment of the present invention.
Figure 3:
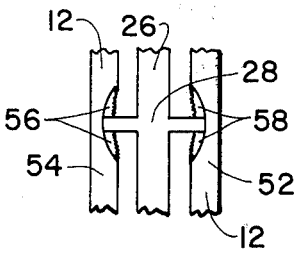
FIG. 3 is a side elevation taken in section along the line 3—3 from FIG. 2 illustrating the axle for mounting a pulley intermediate the ends of the projectile according to one embodiment of the present invention.
Figure 4:
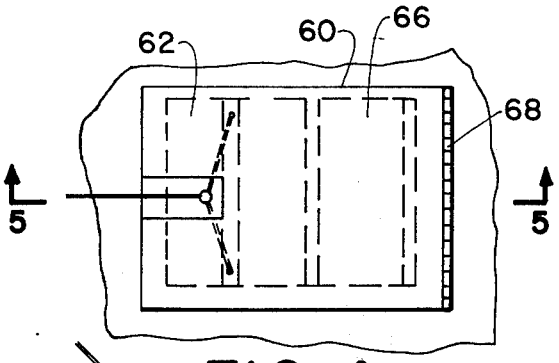
FIG. 4 is a plan view of a ladder container used for paying out a ladder which may be secured to one end of the rope which passes through the projectile according to another embodiment of the present invention.
Figure 5:
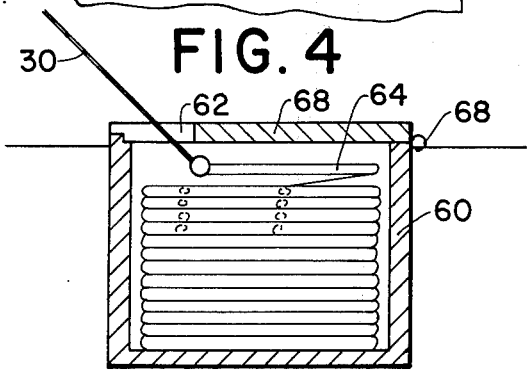
FIG. 5 is a side elevation in section taken along the line 5—5 from FIG. 4.

Referring to the drawing and FIGS. 1 through 5, rescue apparatus 10 is illustrated comprising a projectile body 12 having grappling hook members 14, 16 and 18 projecting from the nose thereof and fins 20, 22 and 24 secured to the opposite end or tail of the projectile 12, the fins providing stability for the projectile in flight, i.e., fins 20, 22 and 24 stabilize the projectile against pitch, roll and yaw. A pulley 26 is mounted intermediate the ends of projectile 12 on axle 28 which is mounted in arcuate slots 52 and 54 in a plane passing through the longitudinal axis of the projectile, the axle 28 being biased by resilient members 56 and 68 such as springs 56 and 58 so that axle 28 is substantially normal to the longitudinal axis of projectile 12.

The diameter of pulley 26 is the same as or greater than the span of tail fins 20 and 24 in order to further assure that line 30 passing around pulley 26 will not become entangled in the fins when the projectile 12 is in flight. Pulley 26 is movable in slots 52 and 54 through an arc up to about a 45 degrees to further prevent projectile 12 from veering off target while in flight because of rope drag.

Guide members 37 and 39 are provided inside of the launching tube 36 from which projectile 12 is launched, guide members 37 and 39 being provided so that fins 20 and 24 may slidingly engage these members as the projectile is launched out of tube 36.

Line 30 is payed out from a first container 34 and a second container 32 which are positoned or separated for a distance sufficient to keep rope 30 from the fins on the tail of projectile 12 when the projectile is in flight.

Tube 36 from which projectile 12 is launched is mounted on support members 40 and 42 through pivots 38 and 40, support members 42 and 44 in turn being secured to a base 46 which is rotatable about pivot 48 mounted on base 50, the rotation of the tube or launcher 36 being such that the muzzle thereof may be swung through an arc of up to about 180°, base 46 being rotatable through an arc of up to about 360° so that the tube 36 may be aimed in a number of directions.

Rope 30, when payed out after projectile 12 is launched and secured to an object may be fastened to a ladder 64 mounted in a container 60 having an opening 62 therethrough, ladder 64 being accessible for storage by means of lid 66 and hinge 68 secured thereto and the wall of container 60.

Winch 70 having pulley 72 thereon may be secured to one end of the rope 30 in order to assist in pulling an object to the projectile 12 when the projectile is secured by means of the grappling hooks thereon to an object. The winch 70 is operated off of a variable speed reversible motor so that the rate and direction of rotation of the pulley 72 may be changed. A vehicle 72 may be employed to transport the rescue apparatus of the present invention, vehicle 72 having lights 74 thereon for night operations.

Rope 30 may be made of any lightweight fire-resistant or heat-resistant material or any material having a high tensile strength such as wire rope e.g., stainless steel wire rope, or a fiber rope made from synthetic polymers or natural materials such as nylon, Dacron (trademark) and the art known equivalents thereof or sisal, hemp and the lile. Stainless steel and synthetic polymer fiber ropes are preferred. An irridescent or phosphorescent coating may be applied to the line 30 or an irridescent or phosphorescent synthetic polymer coated or dyed with such irridescent or phosphorescent material is employed so that the line 30 is better seen, especially at night when lights 74 are aimed at the rope. Ladder 64 may be made of the same material as rope 30.

A propellant charge is used to launch projectile 12, the propellant being either in the base of the projectile 12 such as in the case of a rocket or may be an explosive charge positioned in the bottom of launching tube 36.

In use, the launching tube 36 is aimed at an object by means of sight 70 and the propellant charge discharged whereupon line 30 is payed out from containers 34 and 32 until grappling hooks 14, 16 and 18 are secured to the object to which line 30 is to be attached. The charge used to launch projectile 12 when the projectile is fired as a cannon shot may be varied according to the range to be traversed. Various charges can be loaded into launching tube 36 and can be color coded for different ranges, the different colors representing different distances and propellant charges. Line 30 is then wrapped about pulley 72 on winch 70 and ladder 64 attached to the other side of rope 30 so that it may be positioned or brought up to the object on which grappling hooks 14, 16 and 18 are secured such as the upper story of a building.

Thus, by providing a pulley mounted intermediate the ends of the projectile 12 and sufficiently away from the end of the projectile which receives an explosive force or which has a propellant charge therein, the difficulties of the prior art are obviated wherein the explosive charge is far enough removed from the pulley so that the rope 30 will not be scorched or the charge will not adversely affect the pulley, pulley 26 in the above-described embodiment being sufficiently far away from the end of the projectile so that it is out of the muzzle of the launching tube and away from the hazards of a propellant charge when it is discharged. In one embodiment, the axle of pulley 26 is placed at the substantial center of gravity of the projectile 12 so that the drag force on pulley 26 from lines 30 while the projectile 12 is in flight is less likely to cause the projectile to be thrown off course. Any pitch or yaw of the projectile in flight may be compensated for by the movement of pulley 26 in slots 52 and 54. Containers 34 and 32 are separated for a distance sufficient to keep the rope 30 from entangling in the fins of projectile 12 when the projectile is in flight.

Although the invention has been described by reference to some embodiment, it is not intended that the novel rescue apparatus be limited thereby but that modifications thereof are intended to be included as falling within the broad scope and spirit of the foregoing disclosure, the following claims and the appended drawings.

What is claimed is:

1. Rescue apparatus comprising projectile means and launcher means for launching said projectile, one end of said projectile having a grappling hook means projecting therefrom, the opposite end of said projectile having fin means for stabilizing said projectile in flight, pulley means mounted on said projectile intermediate the ends thereof, first rope storage means and second rope storage means for paying out rope to said projectile while in flight, rope means secured in and leading from said first storage means over said pulley into and secured to said second storage means, the length of said rope being at least twice the distance to be traversed by said projectile, said first and second rope storage means being separate for a distance sufficient to keep said rope away from said fins when said projectile is in flight.

2. The rescue apparatus of claim 1 where said pulley is rotatably mounted on axle means secured to said projectile transverse to and passing through the longitudinal axis of said projectile, said axle being rotatable in a plane passing through said longitudinal axis on pivot means for allowing said axle to move through an arc of up to about 45°.

3. The rescue apparatus of claim 2 further comprising ladder means securable to one end of said rope.

4. The apparatus of claim 2 further comprising winch means connectable to one end of said rope.

5. The rescue apparatus of claim 2 where said axle passes through the center of gravity of said projectile.

6. The rescue apparatus of claim 2 where said pulley has a diameter greater than the span of said fins.

7. The rescue apparatus of claim 2 where said projectile is launched by propellant charge means in said launcher.

8. The rescue apparatus of claim 2 where said projectile is launched by propellant charge means carried in said projectile.

9. The rescue apparatus of claim 2 where said launcher is mounted on axle means transverse to the longitudinal axis of said launcher for allowing said launcher to swing through an arc of up to about 180°, said axle being secured to platform means pivotally mounted on pivot means horizontally rotatable through an arc of up to about 360°.

* * * * *